US008059050B1

(12) United States Patent
Johnson

(10) Patent No.: US 8,059,050 B1
(45) Date of Patent: Nov. 15, 2011

(54) BICONICAL ANTENNA ASSEMBLY

(76) Inventor: Greg Johnson, Aptos, CA (US)

( * ) Notice: Subject to any disclaimer, the term of this patent is extended or adjusted under 35 U.S.C. 154(b) by 576 days.

(21) Appl. No.: 12/331,644

(22) Filed: Dec. 10, 2008

Related U.S. Application Data

(60) Provisional application No. 61/012,649, filed on Dec. 10, 2007.

(51) Int. Cl.
*H01Q 13/00* (2006.01)

(52) U.S. Cl. ..... 343/773; 343/793

(58) Field of Classification Search ..... 343/772, 343/773, 774, 793
See application file for complete search history.

(56) References Cited

U.S. PATENT DOCUMENTS

| | | | | |
|---|---|---|---|---|
| 6,346,920 | B2 * | 2/2002 | Sharp et al. | 343/773 |
| 2001/0004249 | A1 * | 6/2001 | Sharp et al. | 343/824 |
| 2006/0290586 | A1 * | 12/2006 | Lee et al. | 343/801 |
| 2007/0205961 | A1 * | 9/2007 | Black et al. | 343/911 R |
| 2009/0289865 | A1 * | 11/2009 | Parsche | 343/772 |

* cited by examiner

*Primary Examiner* — Hoanganh Le
(74) *Attorney, Agent, or Firm* — Briggs & Morgan PA

(57) ABSTRACT

An biconical antenna assembly including a pair of conductors each having a plurality of radiating conductors. One of the conductors defines a cone shape and radiating conductors extending to define a generally conical form. The other conductor defines a cylindrical shape and radiating conductors extend to define another generally conical form. The conical forms are defined by a pair of sheet conductors and radiating conductors generally divergent about a center point or axis. A feed point is defined generally at the center point. Multiple RF chokes can be provided on the radiating conductors to optimize performance of the antenna over a predetermined frequency range.

20 Claims, 8 Drawing Sheets

BICONICAL ANTENNA ASSEMBLY

RELATED APPLICATIONS

This application claims the benefit of priority of U.S. Ser. No. 61/012,649, filed Dec. 10, 2007, which is hereby incorporated by reference in its entirety.

TECHNICAL FIELD

The invention relates generally to antennas for operation over multiple frequency bands and more particularly to electronic systems intended to detect or suppress (e.g., prevent, disrupt, jam, interfere with or otherwise disable) radio frequency transmissions between transmitters and receivers occurring within particular frequency bands.

BACKGROUND OF THE INVENTION

Radio frequency ("RF") transmission systems and the various wireless devices that operate within such systems are commercially widely available, and nearly ubiquitous, throughout the world with systems coming on-line daily even in the remotest areas of the world. While commercial RF transmission systems are generally thought to improve the overall well-being of mankind and to advance our society, they have found an unintended use in supporting military or terrorist activity of non-friendly countries, organizations, factions, combatants or other groups.

One way by which these non-friendly groups use commercial RF transmission systems is for communication, command, and control. While many commercial RF transmission systems are not secure, their cost and widespread availability, make them an attractive alternative.

Non-friendly groups also use commercial RF transmission systems as detonators for improvised explosive devices ("IEDs"). Typically, combatants fashion an IED using an explosive (e.g., C4), a container (e.g., an unexploded shell) and an RF detonator. The detonator may be wired to a short range wireless remote control device such as an electronic car key, garage door opener, remote control, cordless telephone, or other short range RF transmission device; or to a long range wireless remote control device such as a cell phone, PDA, pager, a WiFi receiver or other long range RF transmission device to enable remote detonation.

The short range wireless devices, by definition, have a "short" or limited range (e.g., approximately 50 meters, more or less) and typically require line-of-sight operation between the device and the IED. Accordingly, these short range wireless devices pose a significant risk to a combatant (e.g. a terrorist, a foe, a member of a non-friendly group or organization, a neutral party, or other combatant) either in the form of risk of detection or risk of injury from the IED itself. However, exceptions arise more frequently as combatants employ more unique methods of remote detonation via RF transmission, for example, cordless phones.

Existing antennae such as conventional dipoles and monopoles suffer from a number of limitations, including narrow frequency coverage, heavy weight, and high visual profile. Dipoles or monopoles with larger cross-sectional area, referred to as "fat" dipoles, provide increased bandwidth, however, are limited to a 3.5:1 frequency bandwidth before the E plane radiation pattern splits into two lobes with a null perpendicular to the antenna major axis. The discone antenna is capable of operation over frequency bandwidths of 10-15:1, however, the beam peak varies considerably from the horizon with frequency, thus affecting useful range. Biconical dipoles that are symmetrical are well known, but provide limited capability, e.g., provide bandwidths comparable to "fat" dipoles.

In light of these and other limitations, dangers and risks associated with RF transmission systems, what is needed is a system and method for detecting or suppressing (e.g., preventing, disrupting, jamming, interfering with or otherwise disabling) RF transmissions between target transmitters and/or target receivers operating in a particular region, thereby disabling the communication, the remote detonation or otherwise suppressing the RF transmissions.

BRIEF SUMMARY OF THE INVENTION

To achieve the foregoing objects, and in accordance with the purpose of the invention as embodied and broadly described herein, a multiple element antenna assembly for a radio frequency communication device is provided.

Embodiments of the invention include an antenna assembly defining a pair of divergent conical radiating structures each including a sheet conductor and a plurality of radiating conductors attached to the sheet conductor and extending in a predetermined form and direction.

Embodiments of the invention include a transceiver that suppresses one or more signals transmitted from a target transmitter in an RF transmission system to a target receiver in a wireless device operating in the RF transmission system to detect, prevent, disrupt, jam, interfere with or otherwise disable an RF transmission between the target transmitter and the target receiver in the wireless device (i.e., target wireless device).

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 8:
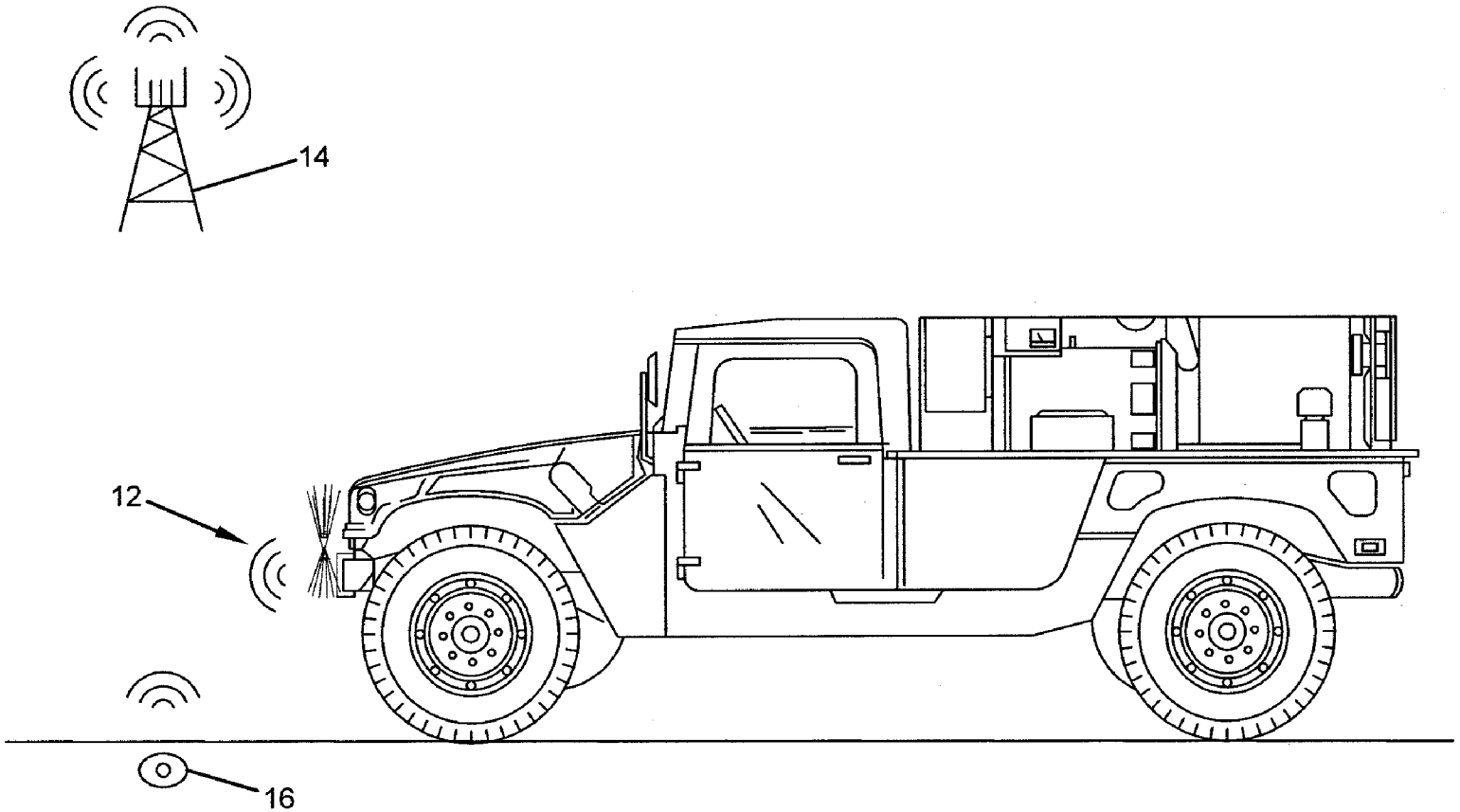
FIG. 8 is a view of an antenna and transceiver as attached to a vehicle.

Referring briefly to FIG. 8, which shows a radiofrequency system including portable antenna 12 and a remote transceiver 14 operates as a base station and relaying an RF signal to a target wireless receiving device 16, for example an improvised explosive device ("IED"). Portable antenna 12 can be used with a transceiver in a defensive manner to detect or suppress RF transmissions from remote transceiver 14 and/or target receiving device 16.

In some environments, if the target transceiver 14 is unable to initiate or otherwise establish and/or maintain an RF transmission with the target wireless receiving device 16, the target wireless device may not be used for communication, command and control. In other applications, if the target transceiver 14 is unable to initiate or otherwise establish and/or maintain an RF transmission with the target wireless device 16, the target wireless device may not be used as, or as part of, a detonator for an IED. Various other embodiments of the invention may thus be used in a defensive manner to detect or suppress RF transmissions to prevent the detonation of IEDs.

Transceiver 14 may initiate or establish RF transmission, including an uplink RF transmission portion and a downlink RF transmission portion, with target receiving device 16. While illustrated as a wireless device, transceiver 14 include fixed, wired, or wireless devices capable of establishing RF transmissions with target receiving device 16 via at least one wireless path that includes an RF transceiver. As illustrated, RF transmissions may be transmitted from a base station or cell tower. In other wireless communication systems (not shown), RF transmissions may be transmitted from satellite or ground-based repeaters or other types of RF transmitters as would be apparent to those of ordinary skill in the art. Radiofrequency transmissions are generally well known and further discussion regarding their operation is not required.

By way of example, antenna 12 may have a favorable direction of azimuthal coverage, and may be externally mounted to a person or vehicle. As disclosed hereinafter, this external antenna may be mounted on a vehicle or other mobile platform.

In addition to antenna configuration, the volume of influence may be affected by other design considerations. These design considerations may include one or more of an amplifier power output, a size of a heat sink for the power amplifiers, heat dissipation, a desired size of the transceiver, a capacity of a battery, an antenna gain, desired frequency bands, a number of frequency bands used, and other design considerations.

Figure 1:
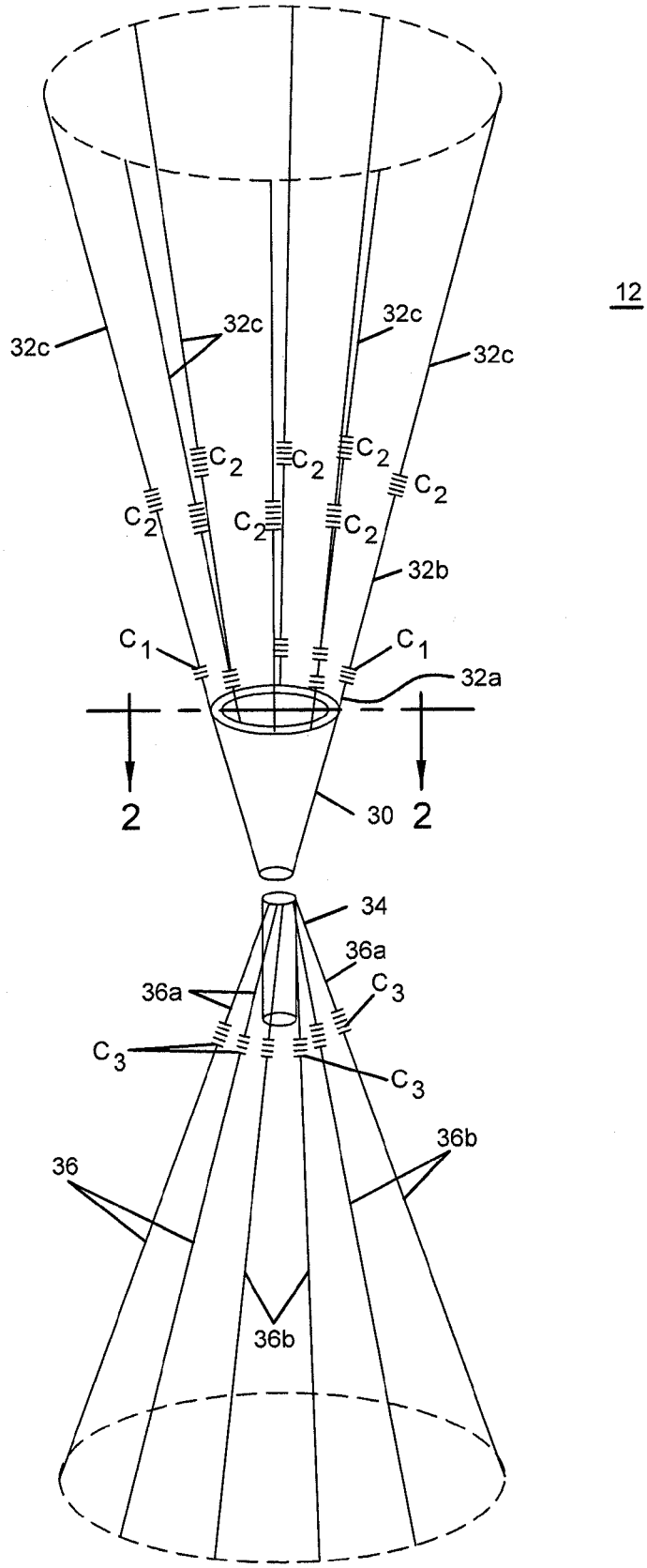
FIG. 1 is a perspective view of an antenna according to the present invention.

Referring now to FIG. 1, antenna 12 includes an upper portion having conical sheet conductor 30 with a number of conductively attached radiating conductors 32 formed into a conical shape. The lower portion of antenna 12 includes a generally cylindrical sheet conductor 34 with a number of flexible radiating conductors 36 conductively attached and formed into a partial conical shape. Sheet conductors 30, 34 may be sheet metal formed into desired shapes. Conductors 36 of the lower portion of antenna 12 are spaced over approximately 180 degrees. This provides for an optimum azimuthal communications range over approximately 180 degrees azimuth, which is desirable for a particular application wherein a man-worn communications system needs optimum coverage in the direction of movement.

Antenna 12 incorporates multiple radio frequency chokes ($C_1$, $C_2$, $C_3$) in the radiating conductors 32. The RF chokes may be simple conductive coils. Chokes $C_1$, $C_2$, $C_3$ facilitate operation over a frequency range of approximately 34:1 by acting as band stops for a higher radio frequency current frequency band, while permitting rf current at a lower frequency band to pass. The number of turns and turn spacing of chokes $C_1$, $C_2$, $C_3$ are selected for optimum performance over frequency bands of interest. While the drawings of the present application relate to an antenna for operation over nominally 80-2700 MHz, one skilled in the art would recognize that this embodiment can be scaled for operation over other frequency bands.

Figure 6:
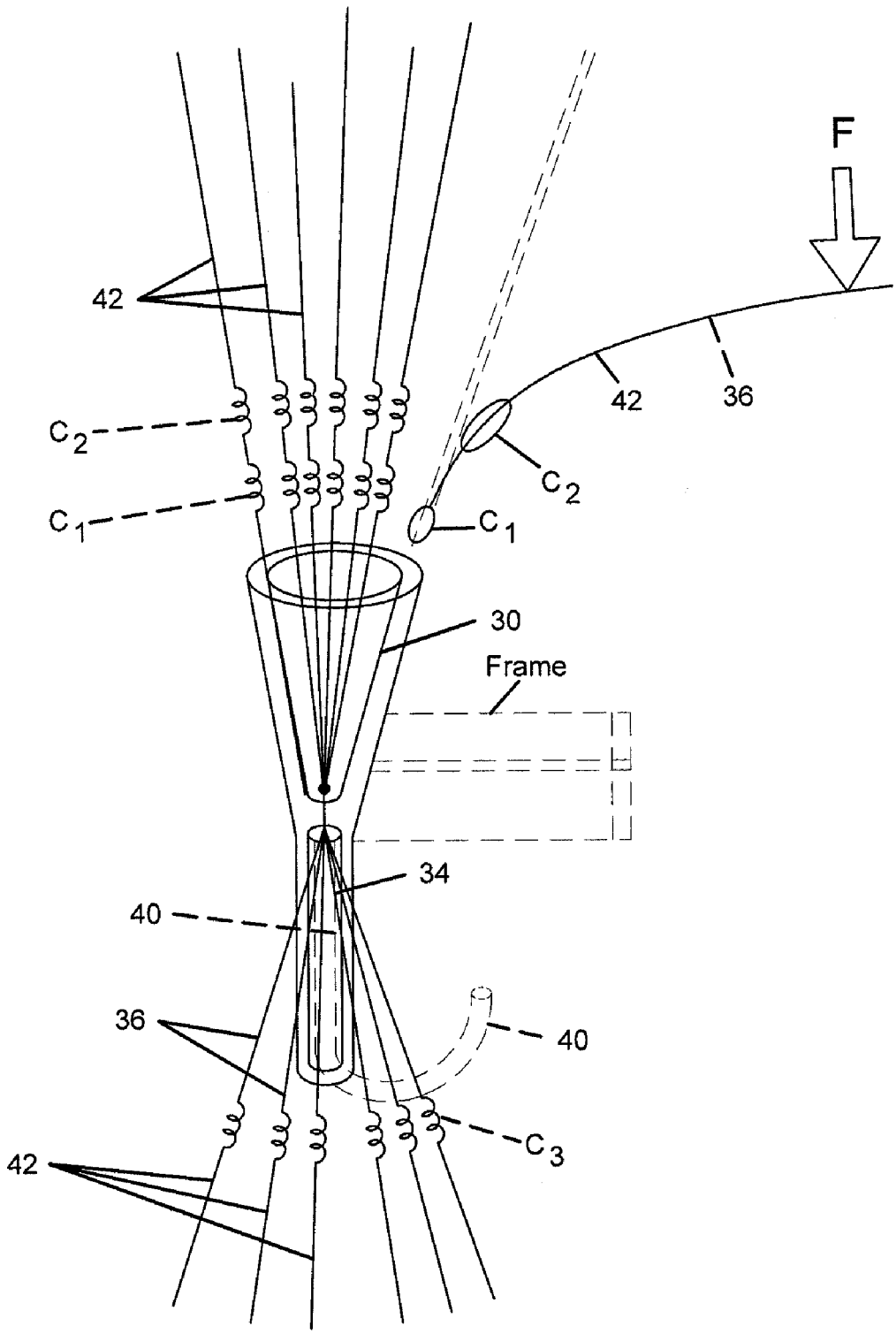
FIG. 6 is a perspective view of another antenna embodiment having protective coverings as shown in FIG. 5.

Antenna 12 is fed at the junction of the two conductors 30, 34 by a coaxial transmission line 40 which may be located along the major axis of the antenna (See, FIG. 6). In one embodiment, antenna 12 is fed by a coax line passing through the cylindrical sheet conductor 34. An rf choke may be located just beyond the bottom of conductor 36 and may be formed from suitable ferrite beads.

Table 1 shows operating dimensions for one embodiment of antenna 12 for operation over 80-2700 MHz frequency range.

TABLE 1

| | | | Choke Coil Dimensions | | | |
|---|---|---|---|---|---|---|
| Antenna element # | Diameter | Length | Wire Diameter | Inside Diameter | # Turns | Coil Length |
| 30 | 1.3" top<br>0.4" bottom | 2.5" | | | | |
| 32a | .047" | ⅝" | | | | |
| C1 | | | .047" | ⅛" | 3.5 | ⅜" |
| 32b | .047" | 4.25" | | | | |
| C2 | | | .047" | .26" | 8 | 1" |
| 32c | .047" | 7" | | | | |
| 34 | 0.47" | 2" | | | | |
| 36a | .047" | 2.5" | | | | |
| C3 | | | .047" | .26" | 3.5 | .25" |
| 36b | 0.47" | 7" | | | | |

Figure 2:
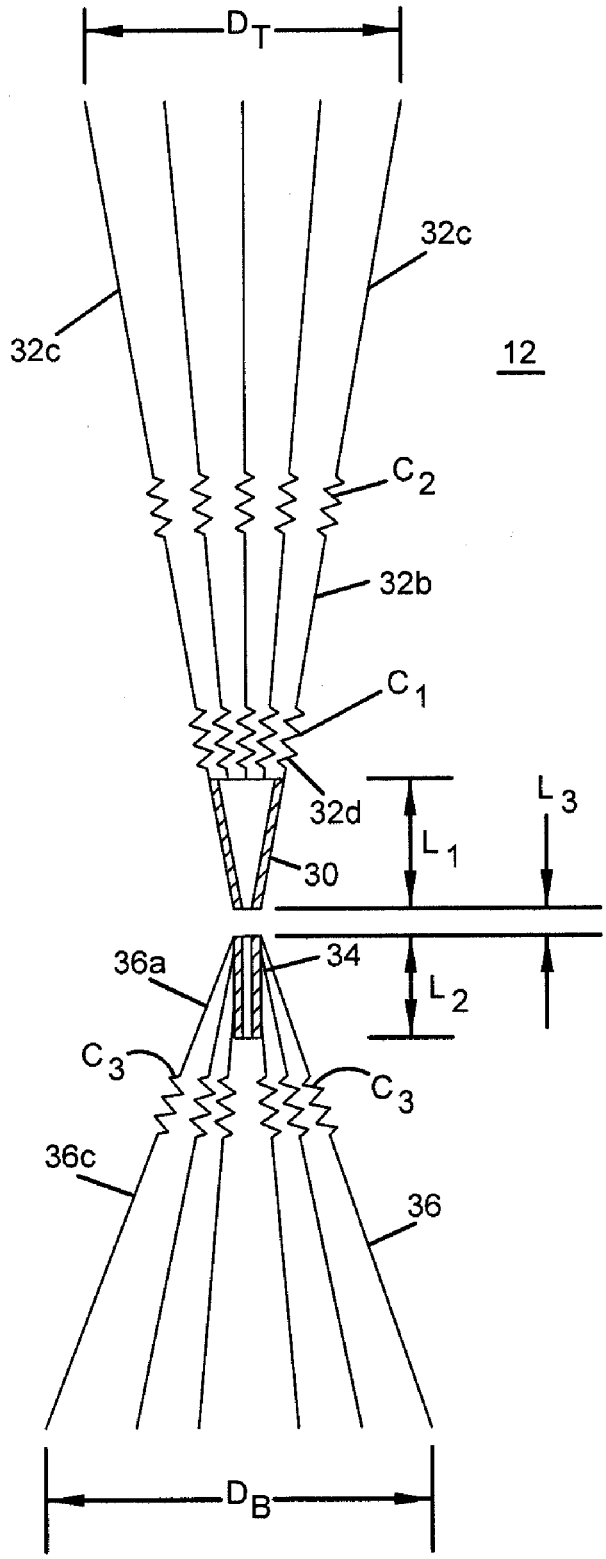
FIG. 2 is a cross section view of the antenna of FIG. 1, taken along lines 2-2.

FIG. 2 is a cross sectional view of antenna 12 of FIG. 1, taken along lines 2-2 in FIG. 1. Dimensions $L_1$, $L_2$, $L_3$, $D_T$ and $D_B$ are 2.5", 2", 0.2", 6" and 7", respectively.

Figure 3:
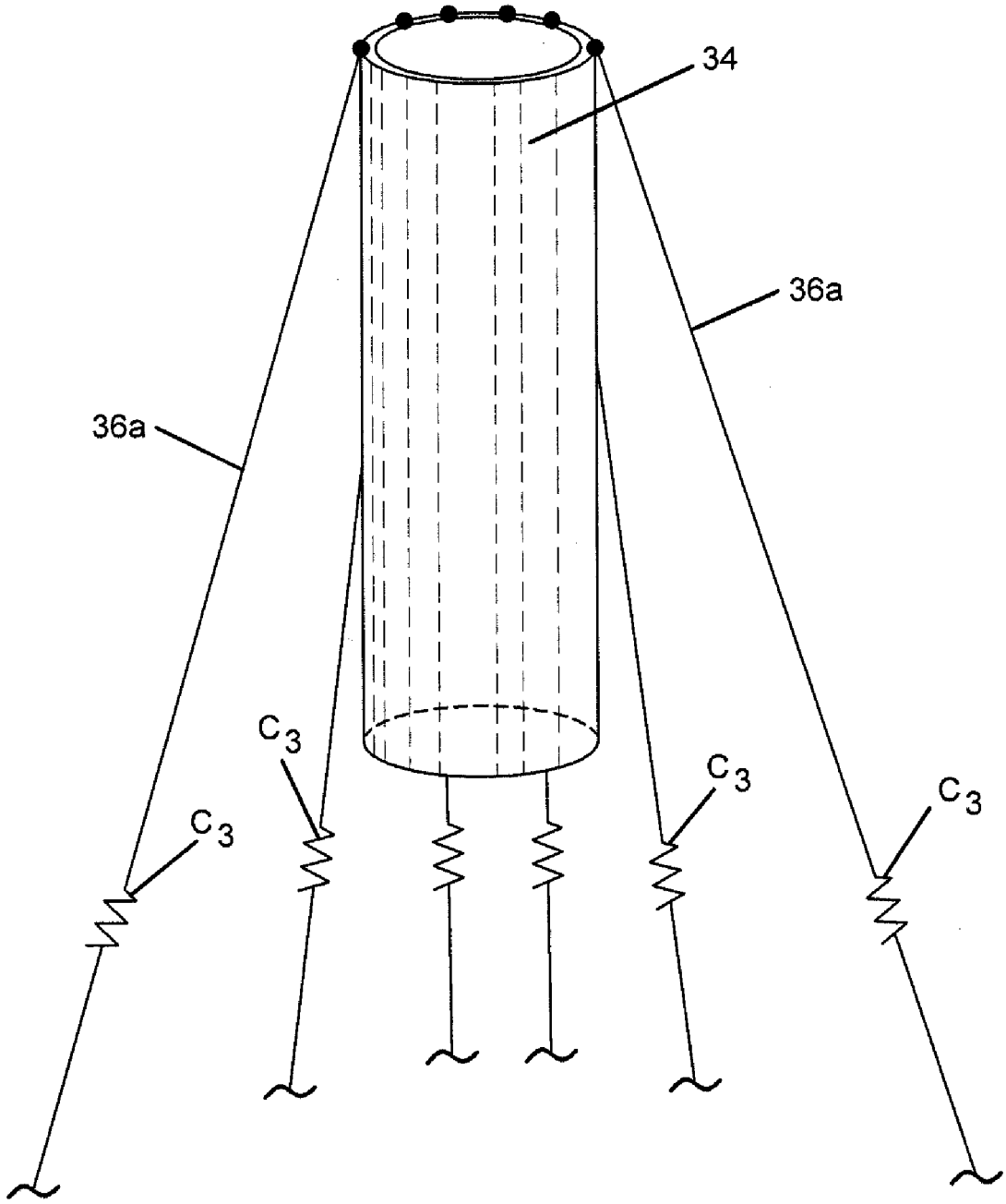
FIG. 3 is a perspective view of a portion of the antenna of FIG. 1.

FIG. 3 is a perspective view of a portion of sheet conductor 34 and its associated radiators 36. Radiators 36 may be conductively coupled at one end to sheet conductor 34 using, for example, solder.

Figure 4A:
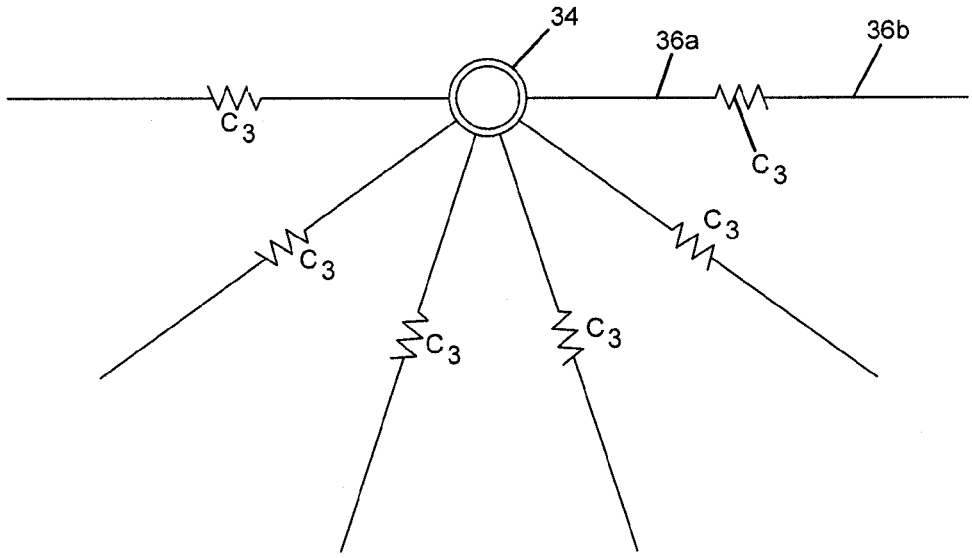
FIGS. 4A and 4B are top view of radiating conductors of the antenna of FIG. 1.
Figure 4B:
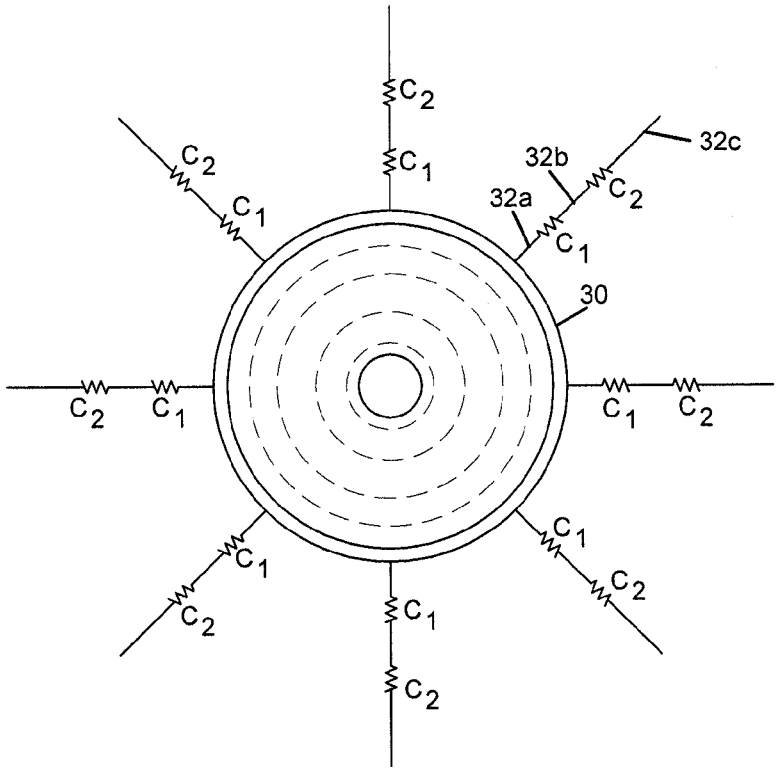

FIG. 4 shows views of antenna 12 taken along the antenna's major axis. FIG. 4*a* is a view taken from beneath the lower portion antenna 12 of FIG. 2 and FIG. 4*b* is a view taken from above the upper portion of antenna 12 of FIG. 2.

Figure 5:
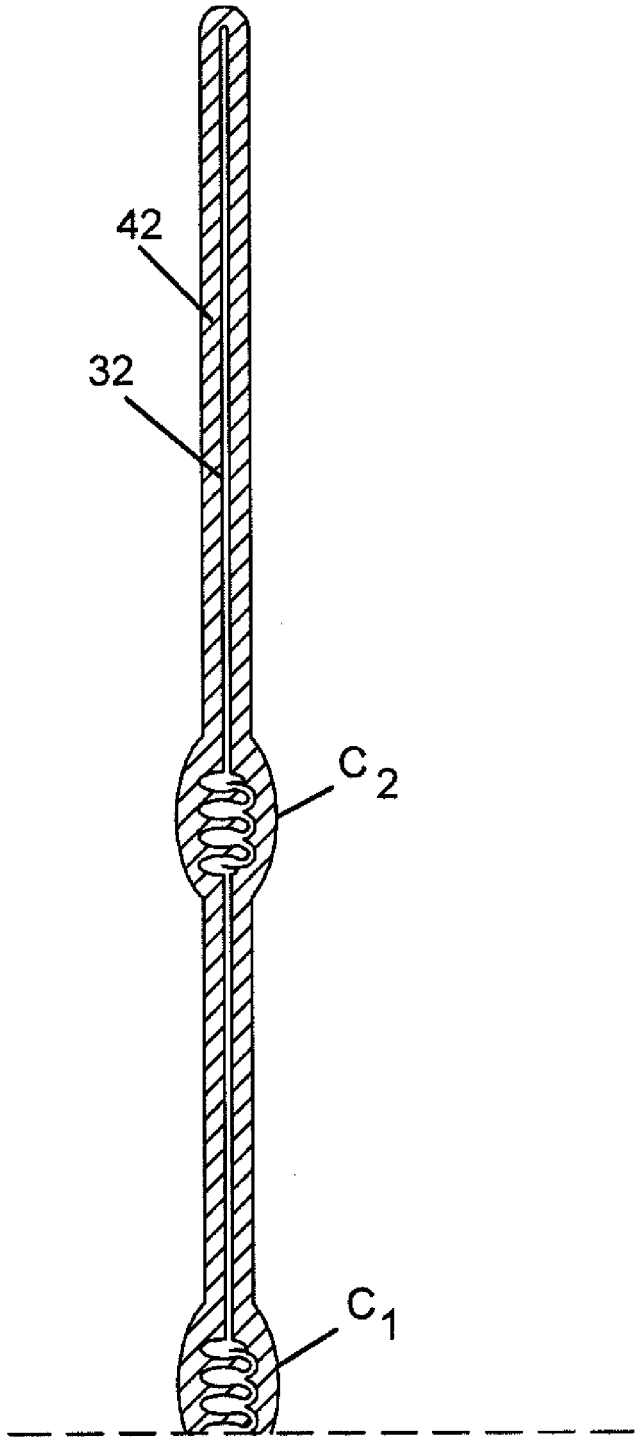
FIG. 5 is a cross section view of a radiating conductor having a protective covering.

FIG. 5 illustrate another embodiment of radiating conductor 32, wherein a protective flexible covering 42 encases the conductor. Covering 42 may be a tubing of heat-shrunk material. Other types of coverings 42 would be apparent to those of ordinary skill in the art. Other protective coverings (not shown) may encase sheet conductors 30, 34.

FIG. 6 illustrates antenna 12 wherein the plurality of radiator 32, 36 are protected by coverings 42. FIG. 6 also illustrates that the radiators 32, 36 are preferably substantially deformable in response to external forces. Radiators 32, 36 are preferably formed of a material having substantial resiliency so that when the external forces are removed, radiators 32, 36 return to their prior orientation. Radiators 32, 36 may be of a spring wire, or of a memory wire, such as Nitonol or other types of nickel-titanium shape memory alloys.

Figure 7:
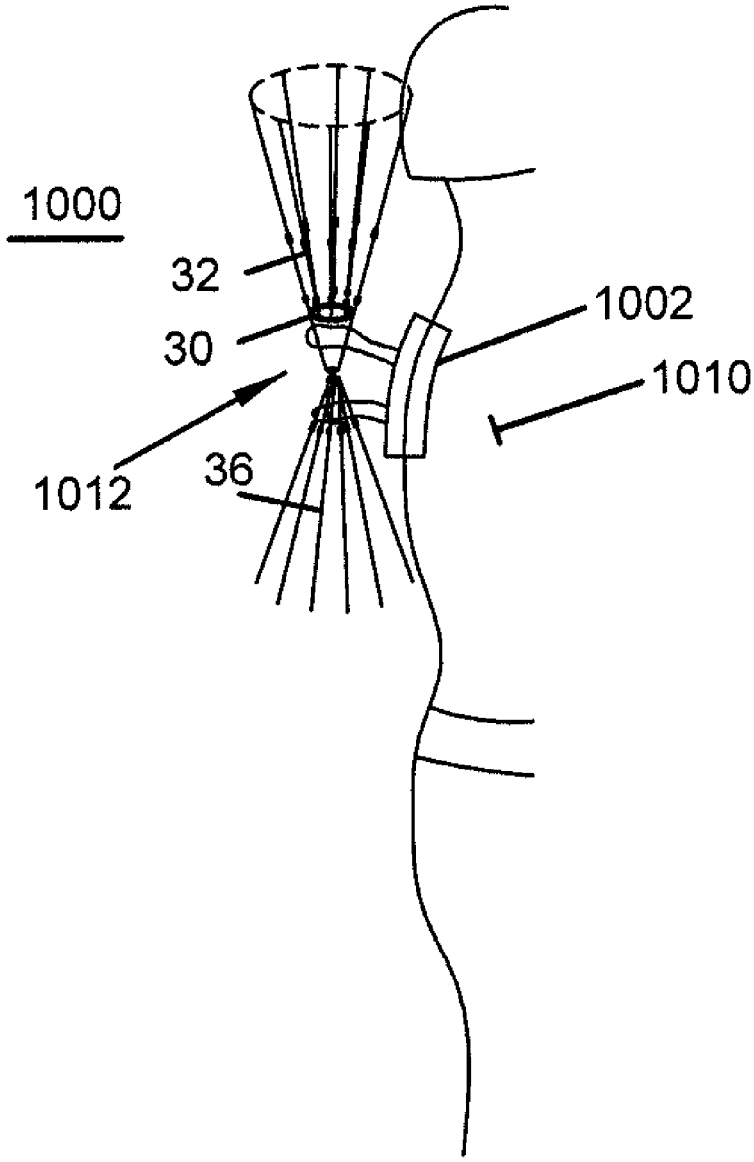
FIG. 7 is a view of an antenna and transceiver as attached to a person.

FIG. 7 is an exemplary illustration of a transceiver and antenna system 1000 adapted for transportation on a vest 1010. Transmitting unit 1000 includes a transceiver 1002 and antenna 1012 and may include mounting members (not shown), that enable transmitting unit 1000 to be mounted to a standard protective vest. In other embodiments, vest 1010 may be adapted specifically for carrying transmitting unit 1000. For example, protective vest 1010 may include a pouch, straps, or other adaptations (not shown) for carrying transmitting unit 1000.

FIG. 8 is an exemplary illustration of a transmitting unit adapted for use on a vehicle, such as the US military's HMMWV. Transmitting unit includes a transceiver 14 and antenna 12 and may include mounting members (not shown) that enable transmitting unit to be mounted to a standard military vehicle. In other embodiments, a transmitting unit may be adapted for air-based platforms, including but not limited to unmanned aerial vehicles.

In some embodiments of the invention, the transceiver may operate (selectably or preset) in frequency bands associated with various mobile telephones, such as, 900 MHz, 2.4 GHz, or other wireless telephone frequency bands. Other mobile telephone frequency bands may include "customized" frequency bands that commercial mobile telephone receivers and transmitters may not be to operate at "out of the box." For example, the "customized" frequency bands may include frequency bands that hostile parties have been able to use in the past (e.g., for remote detonation of IEDs and/or communication) by modifying commercially available wireless telephone components. In some embodiments of the invention, the transceiver may operate (selectably or preset) in frequency bands associated with various short range wireless devices such as an electronic car key, a garage door opener, a remote control, or other short range wireless device. In some embodiments of the invention, the transceiver may operate with various combinations of the wireless frequency bands, the wireless telephone frequency bands, and/or the short range wireless device frequency bands.

In some embodiments, the transceiver may transmit in two, three, four, five, or more different frequency bands. For example, in some embodiments of the invention, the transceiver may operate (selectably or preset) in one or more of the same frequency bands as commercially available wireless communication devices, such as, but not limited to, GSM, CDMA, TDMA, SMR, Cellular PCS, AMPS, FSR, DECT, or other wireless frequency band.

In some embodiments of the invention, the transceiver may detect RF transmissions to a wireless device located within a volume of influence of the detecting transceiver. This volume of influence may be based on various factors including a range between the target wireless device and the transceiver, a range between the target wireless device and the target transmitter, a range between the target transmitter and the transceiver, a transceiver power, a target transmitter power, a target receiver sensitivity, a frequency band or bands of the transceiver, propagation effects, topography, structural interferers, characteristics of an antenna at the transceiver including gain, directionality, and type, and other factors In some embodiments of the invention, the volume of influence may be selected or predetermined to be larger than a volume impacted by the detonation of the IED (i.e., the detonation volume or "kill zone"). In some embodiments of the invention, the volume of influence may be selected or predetermined based on whether the transceiver is stationary (e.g., at or affixed to a building or other position) or mobile (e.g., in or affixed to a vehicle, person, or other mobile platform).

In those embodiments where the transceiver is mobile, the volume of influence may be selected or predetermined based on a speed, either actual or expected, of the mobile platform. In some embodiments of the invention, multiple antennas and transmitters may be used to define an aggregate volume of influence. This aggregate volume of influence may be used to detect and/or suppress RF transmissions around a stationary position such as, for example, a base, a building, an encampment or other stationary position, or a mobile position such as a convoy of vehicles, a division of troops or other mobile position. In further embodiments, the multiple antennas and transceivers may also transmit at different frequencies to suppress RF transmissions from a wide variety of wireless devices.

In some embodiments, the invention may be sized and/or configured to be mounted in, affixed to, or otherwise carried in a military vehicle or a civilian vehicle (e.g., an armored civilian vehicle) such as HMMWV or other military vehicle, a GMC Tahoe, a Chevrolet Suburban, a Toyota Land Cruiser, or other civilian vehicle. In some embodiments, the invention may be sized and/or configured to be carried by a person in a backpack, case, protective vest, body armor or other personal equipment or clothing.

In some of these embodiments, an antenna operating with the transceiver may be affixed to a head apparatus of the person, such as a hat or helmet, or be hand-held. In some embodiments, various components of the antenna may be housed in a ruggedized, sealed, and/or weatherproof container capable of withstanding harsh environments and extreme ambient temperatures.

According to various embodiments of the invention, the antenna and transceiver may be deployed with additional technologies. For example, the antenna and transceiver may be deployed with technologies designed to assess and screen persons, parties, and/or vehicles approaching a designated location, such as, for instance, checkpoints and/or facilities. The screening technologies may be designed to detect bombs being transported by people, within vehicles, or other (e.g., vehicle borne LEDs used in suicide attacks).

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An antenna assembly comprising:

a pair of generally cone-shaped conductive elements directed in divergent directions, with one of the pair of conductive elements comprising:

a generally conical sheet conductor; and a first plurality of radiating conductors conductively attached to and extending away from the conical sheet conductor; and with the other conductive element comprising:

a generally cylindrical sheet conductor; and a second plurality of radiating conductors conductively attached to and extending away from the cylindrical sheet conductor.

2. The antenna assembly of claim 1 wherein the second plurality of radiating conductors are positioned within 180 degrees.

3. The antenna assembly of claim 2 wherein the second plurality of radiating conductors are equally spaced around one side of the cylindrical sheet conductor.

4. The antenna assembly of claim 1 wherein the first plurality of radiating conductors are generally equally spaced around the conical sheet conductor.

5. The antenna assembly of claim 1 wherein the radiating conductors include one or more chokes.

6. The antenna assembly of claim 5 wherein the chokes are defined as a plurality of loops.

7. The antenna assembly of claim 1 wherein the plurality of radiating conductors are covered with a protective element.

8. The antenna assembly of claim 1 wherein the plurality of radiating conductors are of a substantially resilient material, such that upon a deformation in response to an external force, the plurality of radiating conductors return to pre-deformation positions.

9. The antenna assembly of claim 1 wherein the plurality of radiating conductors are of a spring steel alloy.

10. The antenna assembly of claim 1 wherein a radiofrequency feed point is defined between the cylindrical conductor and the conical conductor.

11. An antenna assembly comprising:

a generally conical sheet conductor conductively attached to a plurality of radiating conductors, said conductors extending away from the conical sheet conductor to define a generally conical form; and a generally cylindrical sheet conductor attached to a plurality of radiating conductors extending away from the conductor to define at least a portion of a conical form, said radiating conductors extending in generally opposite directions as compared to the radiating conductors attached to the conical sheet conductor.

12. The antenna assembly of claim 11 wherein the radiating conductors attached to the cylindrical sheet conductor are attached to an edge closest to the conical sheet conductor.

13. The antenna assembly of claim 11 wherein the radiating conductors attached to the cylindrical sheet conductor are attached on one side of the conductor.

14. An antenna assembly comprising:

a generally conical sheet conductor conductively attached to a plurality of radiating conductors, said conductors extending away from the conical sheet conductor to define a generally conical form;

a generally cylindrical sheet conductor attached to a plurality of radiating conductors extending away from the conductor to define at least a portion of a conical form, said radiating conductors extending in generally opposite directions as compared to the radiating conductors attached to the conical sheet conductor; and a feedpoint adapted for connection to an RF transceiver, said feedpoint being defined between the conical sheet conductor and the cylindrical sheet conductor.

15. The antenna assembly of claim 14 wherein the feedpoint includes a pair of conductors, with one of the pair of conductors connected to the conical sheet conductor and the other conductor attached to the cylindrical sheet conductor.

16. The antenna assembly of claim 14 wherein a coaxial line extends through the cylindrical sheet conductor and terminals at the feedpoint.

17. The antenna assembly of claim 14 further comprising a frame connecting the conical sheet conductor to the cylindrical sheet conductor, said frame being attached to a vehicle or aircraft.

18. The antenna assembly of claim 14 wherein at least some of the plurality of radiating conductors include an RF choke.

19. The antenna assembly of claim 18 wherein at least some of the plurality of radiating conductors include a pair of RF chokes, with the pair of RF chokes being selected to optimize operation of the antenna assembly across a predetermined frequency range.

20. The antenna assembly of claim 14 wherein at least some of the plurality of radiating conductors are resilient and return to a predeformed orientation after a deformation force is released.

* * * * *